US006675849B1

(12) United States Patent
Lackley

(10) Patent No.: US 6,675,849 B1
(45) Date of Patent: Jan. 13, 2004

(54) ADJUSTABLE TENONING SHIM

(76) Inventor: Mark Lackley, 18 College Hill Rd., Woodstock, VT (US) 05091

( * ) Notice: Subject to any disclaimer, the term of this patent is extended or adjusted under 35 U.S.C. 154(b) by 0 days.

(21) Appl. No.: 10/370,146

(22) Filed: Feb. 19, 2003

(51) Int. Cl.[7] ..... B27M 1/00; B27C 1/00; B27C 5/00

(52) U.S. Cl. ..... 144/363; 29/428; 29/525.01; 83/665; 83/698.41; 144/218; 144/237; 144/238; 407/31; 407/48; 407/60

(58) Field of Search ..... 83/664, 665, 425.2, 83/425.3, 698.41; 407/31, 40, 41, 48, 60; 144/218, 237, 238, 363; 29/428, 525.01

(56) References Cited

U.S. PATENT DOCUMENTS

| | | | | |
|---|---|---|---|---|
| 1,545,293 A | | 7/1925 | Ware | |
| 2,788,812 A | | 4/1957 | Jacobs | |
| 3,780,780 A | * | 12/1973 | Pettigrew et al. | 144/238 |
| 4,589,458 A | | 5/1986 | McCord, Jr. | |
| 5,303,754 A | | 4/1994 | Rautio | |
| 5,309,962 A | | 5/1994 | McCord, Jr. et al. | |
| 5,316,061 A | | 5/1994 | Lee | |
| 5,368,079 A | | 11/1994 | Benway | |
| 6,367,524 B1 | | 4/2002 | Brewer | |
| 6,463,970 B1 | * | 10/2002 | Bradshaw | 144/237 |

OTHER PUBLICATIONS

Tenoning Strategies by Gary Rogowski, Fine Woodworking Magazine, vol. #142, pp. 60–67.

Double–Blade Tablesaw Tenoning by Mac Campbell Fine Woodworking Magazine, Jul./Aug. 1992, pp. 72–75.

* cited by examiner

*Primary Examiner*—W. Donald Bray
(74) *Attorney, Agent, or Firm*—St. Onge Steward Johnston & Reens

(57) ABSTRACT

The invention relates to a device and method for making tenons using an adjustable shim placed between cutting blades. The adjustable shim has a plate with a recess capable of accepting spacers of varied thicknesses and a cover that encloses any of the spacers placed in the recess. The thickness of the adjustable shim is adjusted by placing spacers in the recess to shim apart the cutting blades leaving between them a distance approximately equal to the desired tenon thickness.

8 Claims, 3 Drawing Sheets

ADJUSTABLE TENONING SHIM

FIELD OF THE INVENTION

The present invention relates to the field of woodworking. More particularly, it relates to adjusting table saw blades for cutting tenons in wood.

BACKGROUND OF THE INVENTION

One of the most universal woodworking joints is the mortise (the female part of a joint) and the tenon (the male part). While some jigs for making tenons do exist, they are not widely used for several reasons. First, the tenon is generally a joint that is unseen and, therefore, going to the trouble of making tenons is often not justifiable to the professional or amateur woodworker. Also, there is no convenient jig system which makes precisely fitting pairs of mortises and tenons on a repeated basis.

To properly make a tenon and mortise type joint requires two very separate operations. Firstly, cutting out the mortise from a first work piece and secondly, cutting a tenon from a second work piece. Mortises are easily and efficiently produced with a hollow chisel mortiser (either a dedicated one or a mortiser that fits on a standard drill press) or with a plunge router. The problem has always been the easy and efficient production of the tenon and, specifically, controlling the thickness of the tenon. While there are prior art jig systems such as the three-dimensional router-based system sold under the name "Multi-Router." This prior art system is claimed to be able to produce matching mortises and tenons; however, that system costs roughly $3,000-beyond the reach of most woodworkers.

Many traditional uses for tenons have been circumvented by modern technology, such as plate joinery, also called "biscuit" joinery, and the development of the router- and shaper-based machining of stiles and rails, which produces essentially a stub-tenon in a groove instead of a true mortise and tenon joint. However, a true tenon and mortise joint is a superior joint and the serious woodworking hobbyist and professional woodworker desire a tool that would help them make more consistent tenons. Well-fitting tenons are a matter of pride for woodworkers. Currently, accurately dimensional tenons are also a source of consternation and anxiety due to the difficulty in their creation.

Because tenons have long (generally over an inch) and broad surfaces, maintaining a consistent thickness over the entire body of the tenon is problematic. Using currently known methods, each face of the tenon (called a "cheek") is machined separately, which creates the opportunity for dimensional error in the width of the tenon.

Using prior art systems, when woodworkers first try to cut a tenon on a table saw (especially if they are untrained), they usually try laying the board down on its side and using "dado blades" (multiple cutting blades and shimming blades ganged together that remove a lot of material in one pass) to remove the material and leave the cheeks. This is quick because the shoulder cuts (the cuts that determine the length of the tenon) are made as the dado blade passes under the tenon, removing the material and revealing one cheek. But this operation requires two passes, one for each cheek, and is not accurate and leads to very rough cheeks, which either have to be hand-planed down or left rough, resulting in a less secure joint.

Woodworkers know that when they make doors, the machining must all be done with a chosen face of each part referencing the cutting tool. This is so that any error created by small differences in the thickness of the parts or misalignment of the cut will end up on the same side of each board cut.

Under another prior art method, tenons are often cut on a table saw using one reference face of the work piece against the fence for cutting one cheek, then flipping the work piece around and using the second face as a second reference face for cutting the second cheek. Because different reference faces are used, this method invites error and results in inaccurate tenon widths.

Under existing prior art methods, making tenons is more accurate when the operator pays attention to which face of the board is against the fence, or guide, for each cut and uses the same reference face when making all the tenon cuts. However, this method requires moving the fence and fine-tuning the thickness of the tenon by minute adjustments of the table saw fence. It is a tedious method based on trial and error and much material often ends up being wasted before the right fence adjustment is located.

While some prior art shows spacers between cutting blades, none of them would be effective in cutting a true tenon. It is well known in the art to place a spacer between dado blades. For example, U.S. Pat. No. 6,367,524 B1 issued to Brewer discloses an adjustable bit having a spacer between two cutting blades. However, as the abstract of Brewer discloses, the adjustable bit with cutting blades is for cutting shallow tongues or grooves. The adjustable bit disclosed in Brewer cannot be used to cut true tenons because the router disclosed lacks sufficient cutting power to remove a cheek with the depth required to form a true tenon. Further, the spacers disclosed in Brewer are exposed to wood chips and contaminants which can lodge between the spacers.

There are also other prior art systems showing spacers between cutting blades such as U.S. Pat. No. 5,368,079 issued to Benway, U.S. Pat. No. 5,316,061 issued to Lee and U.S. Pat. Nos. 4,589,458, and 5,309,962 issued to McCord Jr. et al. However, these prior art systems all relate to dado type blades and adjusting the distance between the blades to change the width or the size of the cut, slot or groove to be made. The adjustment of the blades determines how much material will be removed and not the amount of material to remain between the cuts made by the cutting blades.

One attempted solution to the problem of making tenons is to put spacers or shims between two table saw blades corresponding to the desired tenon width. The woodworker places custom made spacers of steel and/or brass between the two saw blades and makes test cuts of the work piece on a trial and error basis until the desired tenon width is achieved. This trial and error method has many drawbacks. It can be cumbersome due to the repeated addition and removal of individual shims of numerous different size onto the thread of the table saw arbor. Each individual spacer needs to be assembled separately on the arbor with some of the thinner spacers often being caught between the threads of the arbor during assembly. Further, the spacers are specially machined from steel and/or brass adding to the expense of the spacers. Also, if thin individual steel spacers are used and they do not abut each other in a flat and flush manner, they can spring and flex causing a spring effect that makes the spacing between the cutting blades inconsistent, unreliable and unrepeatable. Additionally, if spacers are placed individually on the arbor, they can be exposed to contaminants such as wood chips, sawdust or dirt which may lodge between the spacers and alter the desired spacing between the spacers.

What is desired is a simple adjustable tenoning shim for use between cutting blades for cutting tenons that is adjustable over a wide range of tenon sizes, is easy to use, easy to assemble, is not susceptible to contaminants and can be used to make accurate tenons on a repeated and consistent basis. What is also needed is a simple adjustable tenoning shim that permits the woodworker to cut an accurate tenon and remove both cheeks after a single pass through the cutting blades using a single reference surface.

With the present invention, only one face is referenced because only one pass is needed to cut the tenon cheeks. And once the adjustable shim has been set and a fence adjustment has been found for a given tenon size, the same shim adjustment can be used and the fence can be dialed back to the same position the next time a given tenon size is required. This is because the adjustable shim, rather than the table saw fence, is being used to size the tenon. Instead, the fence is just being used to locate and position the tenon relative to the thickness of the tenon board. Any small error in position of the tenon relative to the thickness of the work piece is meaningless and will not at all affect the fit of the joint.

SUMMARY OF THE INVENTION

The invention provides a quicker, more accurate, and repeatable way for the home-shop and professional woodworker to size tenons to fit mortises while avoiding misadjustments due to clogging from sawdust and preventing a spacer from slipping between the threads of the arbor used to support the saw blades. This is achieved in one form of the invention by mounting a spacer within a recess of a separate plate and seating a clamping segment or cover over the spacer. In this manner the spacer is held within the recess and is isolated from contaminants such as wood chips and sawdust and cannot become caught on the threads of the table saw arbor.

In the preferred embodiment, an adjustable shim fits on the table saw arbor between two cutting or saw blades so as to shim the blades a distance apart that is approximately equal to the thickness of whatever tenon is desired. A separate plate or housing has a coaxial recess and a cover or clamping hub has a portion that projects into the recess to clamp and hold one or more spacers between the plate and cover when the blades are pressed together on the arbor. The spacer thickness can be selected within a range that is generally less than the depth of the recess, thus enabling the operator to choose, with the thickness of the shim, a desired saw blade separation to make a tenon of a particular thickness. When the spacer is so installed and pre-assembled into the plate, the plate and the clamping hub or cover prevents sawdust from interfering with the spacer within the plate. Further, due to the plate and cover, the spacer does not contact the arbor at any time during assembly or use of the cutting blades or saw blades.

The plate has a recess defining a receiving area for receiving a spacer. By selecting spacers of various thicknesses, one can determine the overall thickness of the adjustable shim. The adjustable shim is preassembled by placing the spacer against the inside wall of the recess in the plate and placing the cover over the spacer. The cover holds and maintains the spacer in a position up against the inside wall. The cover has an outer face such that when the adjustable shim is assembled and the spacer is adjacent the inside wall, the outer face extends axially beyond the plate face. Once pre-assembled, the adjustable shim can then be placed in position on the table saw arbor in a single step.

The overall thickness between the plate and the outerface of the cover determines the distance between the cutting blades and thus the width of the tenons. In the preferred embodiment, the shim may be sized to produce tenons for mortises ¼ inch in thickness and larger. Additionally, with the preferred embodiment, spacers in thicknesses of 1/16", ⅛" and ¼" allow for spacing between the blades to produce tenons from 5/16" through ½" thick in addition to the ¼" tenons made by the preferred embodiment.

DETAILED DESCRIPTION OF THE DRAWINGS

Figure 1:
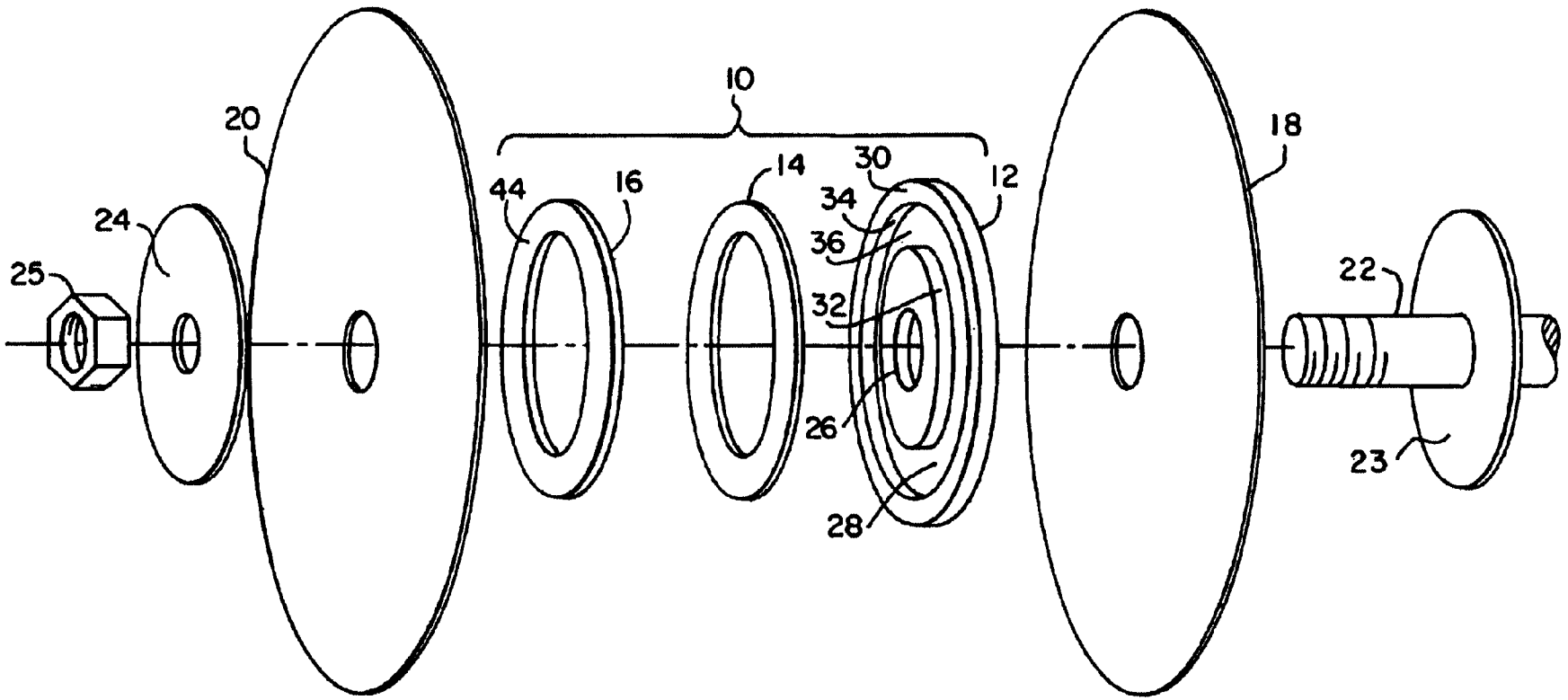
FIG. 1 is an exploded view of the of the preferred embodiment of the adjustable shim between two cutting blades on an arbor.

The preferred embodiment of the adjustable shim 10 can be best seen in FIG. 1. In the preferred embodiment, the adjustable shim has three main components, a plate 12 with a recess or receiving area 28, a spacer 14 and a cover 16. FIG. 1 shows an exploded view of the adjustable shim between two table saw blades 18, 20 to be mounted on an arbor 22. The adjustable shim and table saw blades are mounted on the arbor between a blade support plate 23 and washer 24 and are held on the arbor by a nut 25 or some other type of fastener.

Figure 2:
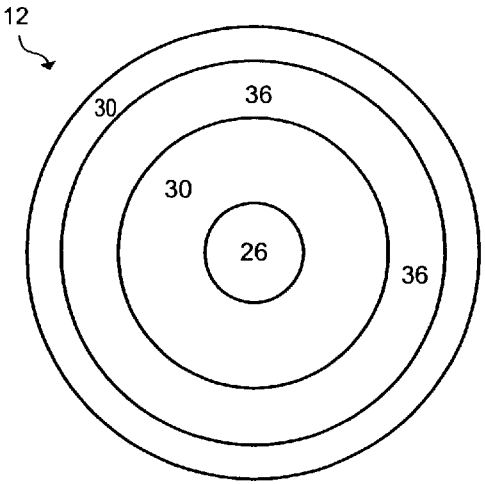
FIG. 2 is a side view of the plate of the adjustable shim shown in FIG. 1.
Figure 3:
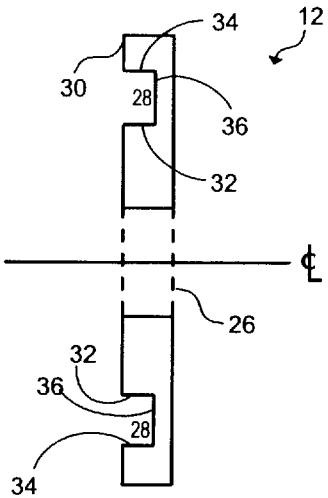
FIG. 3 is a cross sectional view of the plate shown in FIG. 2.
Figure 5:
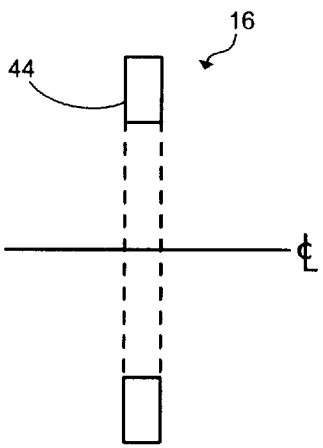
FIG. 5 is a side view of the cover shown in FIG. 4.

FIG. 2 shows a front view of plate 12, while FIG. 3 shows a side view of the plate 12. In the preferred embodiment, the plate 12 is circular in shape with an outside diameter of 2.5 inches or larger, depending on the model appropriate to that table saw and a hole 26 in its center with a diameter of 0.63 inches to fit the standard arbor 22 of a table saw. Because the thickness of the plate 12 is the minimum thickness for the adjustable shim 10 in the preferred embodiment, the plate thickness is approximately 0.27 inches. Using an adjustable shim having a thickness of approximately 0.27 inches between standard table saw blades yields a tenon of just under 0.25 inches thick, a nominal size to mate with a slightly undersized ¼ inch mortise. In the preferred embodiment, with no machinist shims in the recess, tenons of approximately 0.220 inches are produced. Also in the preferred embodiment, to produce a tenon of approximately 0.25 inches, one or more spacers having a total thickness of approximately 0.030 inches are used. The plate 12 has a recessed receiving area 28 for receiving spacer 14 and holding spacer 14 when the adjustable shim 10 is pre-assembled and positioned on the arbor 22. Like the plate 12, the recess or receiving area 28 is circular in shape and is machined into the outer face or front side 30 of the plate.

As best seen in FIG. 3, the preferred embodiment has a recessed receiving area 28 formed by an inside wall 32, an outside wall 34 and an inner face 36 of the plate which lies between the inside and outside wall at a depth of approximately 0.180 inches from the outer face 30 of the plate. Preferably, the inside wall 32 is located approximately 0.745 inches from the center line of the plate 12 and the outside wall 34 is located approximately 1.0675 inches from the center line of plate 12. Thus, in the preferred embodiment, the receiving area 28 has an inside diameter of approximately 1.490 inches and an outside diameter of approximately 2.135 inches.

These preferred dimensions for the recess or receiving area 28 allow for the use of circular-shaped, standard hardened steel machinist spacers, shims or washers for use as spacers in the adjustable shim. A set of standard machinists shims having various thicknesses from 0.001 to 0.125 inches can be readily purchased relatively inexpensively. All the standard machinist spacers in the set share the same circular envelope dimensions of the recess 28 having an inside diameter of approximately 1.495 inches and an outside diameter of 2.130 inches. Use of standard machinist shims or spacers reduces the cost of the spacers by not requiring the use of brass or other expensive materials and eliminating the need for custom made spacers. The spacers can be combined in any number or combinations to adjust the width of the adjustable shim to yield a tenon of the desired width. By being able to adjust the adjustable tenon shim and thus the tenon width by as little a 0.001 inches, the woodworker is able to cut a tenon well within the tolerance needed for an optimum mortise fit.

Because spacers of different thicknesses may be difficult to tell apart, the invention contemplates color-coding the spacers for different thicknesses. For example, a spacer 0.003 inches thick could be marked with indicia of the color red and a spacer 0.005 inches thick could be marked with indicia of the color blue. A chart could accompany the spacers, indicating the different spacer thickness for each different color spacer. By coloring or otherwise marking the spacers with other indicia to correspond to different spacer thicknesses, the color or indicia would act as indicators of thickness, making it easy to select a spacer of the desired thickness without measuring or carefully inspecting the spacer. Additionally, with color-coded spacers, the woodworker could quickly find a spacer of the desired thickness and could easily record which spacers were used by recording which different colors were used, in the event the woodworker desired to make a similar tenon at a later date. Other types of indicia could also be used to indicate the difference in thickness between the spacers such as larger numbers, symbols or letters marked on the face of the spacers.

Figure 4:
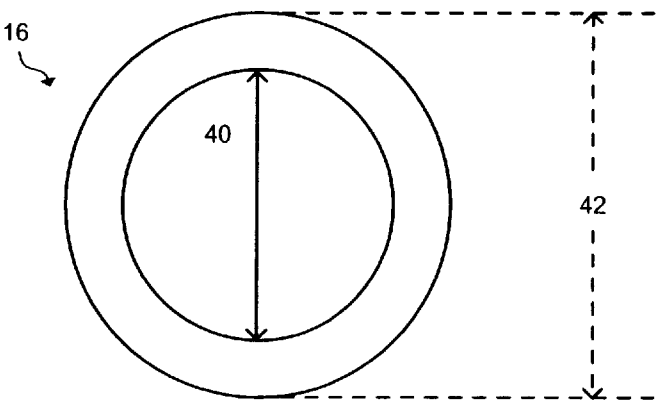
FIG. 4 is a front view of the cover of the adjustable shim shown in FIG. 1.

FIG. 4 shows a front view of the cover 16. The cover 16 has an inside diameter 40 and an outside diameter 42, sized to fit between the inside wall 32 and outside wall 34 of the plate 12. Like the preferred dimension of the spacers, the cover of the preferred embodiment has an inside diameter of approximately 1.495 inches and an outside diameter of approximately 2.130 inches. The preferred width of cover 16 is approximately 0.1875 inches or approximately equal to the depth of the recessed receiving area 28 such that when the adjustable shim is pre-assembled without a spacer and just the plate 12 and cover 16, the outer face 44 of the cover 16 is flush with or extends slightly beyond the outer face 30 of the plate 12. Accordingly, once a spacer (or spacers) is (are) placed in the receiving area 28 between the plate 12 and the cover 16, the outer face 44 of the cover will extend out beyond the outer face or front side 30 of the plate 12, a distance equal to the amount of the width of the inserted spacer or spacers 14.

Figure 6:
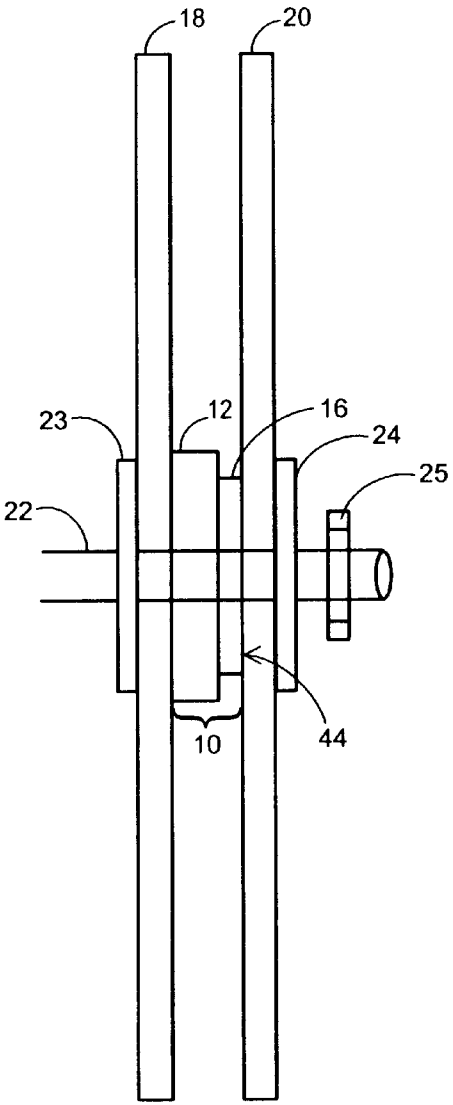
FIG. 6 is a side view of the adjustable shim mounted between two cutting blades on an arbor

The method to preassemble and use the adjustable shim is as follows. First, the plate 12 and cover 16 are preassembled, either with or without a spacer 14, to provide an adjustable shim that approximates the thickness of the desired tenon. The adjustable shim is preassembled either by placing the cover 14 in the receiving area 28 or by placing spacer 14 with the desired thickness in the receiving area 28 of the plate 12. If a spacer 14 is placed in the receiving area 28, the cover 14 is also then at least partially assembled into the receiving area 28 over the spacer 14, forcing and holding. the spacer 14 up against the inside wall 36 of the plate 12. The first cutting blade 18 is assembled on the arbor 22 followed by the preassembled adjustable shim 10 which is pressed up against the first cutting blade 18. The second saw blade 20 is then assembled onto the arbor 22 until it is pressed up against the outer face 44 of cover 16 of the adjustable shim 10. The second cutting blade 20 is then held in place on the arbor 22 by washer 24 and a fastener or nut 25. FIG. 6 shows a side view of the shim assembly 10 in the assembled position on an arbor 22 between two cutting blades 18, 20.

When the adjustable shim 10 is preassembled, any spacers 14 in the receiving area 28 are completely enclosed between the plate 12 and cover 16. Because the spacers 14 are completely enclosed within the plate 12 and cover 16, spacers with thin widths will not be caught on the threads of the arbor 22 during assembly onto the arbor. Also, when multiple spacers are used, they can all be pre-assembled and held in the recess or receiving area 28 at the same time during assembly onto arbor 22, thereby saving the time and effort required for mounting and dismounting the spacers individually from the arbor. Mounting spacers individually or as a group when not contained in a plate can be very difficult to handle especially when the spacers are thin. Using plate 12 and cover 16 allows for easy one step assembly of multiple spacers when mounting them on the arbor.

Additionally, after using the assembled plate, cover and spacers, the user can remove the adjustable shim from the arbor and store the adjustable shim fully assembled for use at a future time when additional tenons with the same dimensions are desired.

Once the adjustable shim 10 is mounted on the arbor 22 between two blades 18, 20, a sample tenon is cut made using any type of jig to properly hold the work piece in place as the work piece passes by the two cutting blades 18 and 10. As the work piece passes through the cutting blades 18, 20, the blades cut both cheeks of the tenon. Once the cheeks are removed the woodworker then attempts to fit the tenon in the desired mortise. If the tenon does not have the desired fit with the mortise, the woodworker removes the adjustable shim 10 from the arbor 22 and adds (or subtracts) a spacer 14 to or from the recess 28 of the adjustable shim 10. If the woodworker increases the thickness of the adjustable shim by replacing a spacer with a thicker spacer or by adding an additional spacer 14, then the tenon thickness will increase. Alternatively, if the woodworker decreases the thickness of the adjustable shim by removing a spacer and/or replacing it with a thinner spacer, then the tenon thickness will decrease. By adding or subtracting spacers to the receiving area 28 of the adjustable shim 10, the woodworker can adjust the overall thickness of the adjustable shim to insure that the tenon will have the desired thickness for fitting in the mortise.

For example, if the preferred embodiment, if a ¼ inch thick tenon is desired, the plate 12 and cover 16 are assembled without a spacer and is placed on the arbor 22 between the cutting blades 18, 20. A tenon is then cut and is measured by trying to insert the tenon into a mating mortise. If the tenon is too thin by 0.003 inches, the adjustable shim 10 is removed from the arbor and a 0.003 spacer is placed in the recess 28 of plate 12 and the cover 16 is placed back into the recess compressing the spacer(s). The adjustable shim is then reassembled on the arbor and a new tenon is cut which is 0.003 inches thicker than the old tenon resulting a perfect fit with the mortise. At the end of the operation, the woodworker notes which blades were used, the location of the fence and the particular spacers used in the adjustable shim. These notes are referred to when coming back later to make tenons of the same or larger thickness.

Additionally, because the plate 12 and cover 16 enclose any spacers 14 in the receiving area 28 during use of the saw blades, the spacers 14 are not exposed to any contamination such as wood chips, sawdust or dirt that may lodge between the plate 12, spacer 14 or cover 14. Preventing contaminants from causing gaps or spaces between the elements of the adjustable shim 10 helps insure the adjustable shim 10 will have the same overall width and yield tenons with the same width on a repeated and consistent basis.

The invention also contemplates the use of additional spacers with various widths or axial thickness. The use of multiple spacers of different thicknesses is necessary because the following factors create discrepancies in the thickness of a tenon created by trimming it between two saw blades: (a) how well the table saw is tuned (how true it runs) in terms of whether the blade is parallel to the saw fence and/or miter slots, (b) blade runout (wobble at the end of the blade), (c) blade brands, (d) the number of times the blade has been sharpened (carbide tooth thickness is reduced by as must as 0.010" over the life of a blade through sharpening); and (e) imperfect application of carbide teeth to the steel body of the blade. Adjustability is also necessary because different brands of mortising chisel and router bits (the two tools most often used to create mortises) vary in thickness and the processes used to cut mortises create their own variables. The invention offers a device and method that allows the woodworker to overcome the problems and discrepancies in thickness of tenon created by these many factors.

What is claimed is:

1. A structure assembled on an arbor for forming a tenon comprising:

a first cutting blade;

a plate having a recess;

a spacer sized to fit in said recess;

a cover for holding the spacer in the recess;

a second cutting blade; and said spacer being located within said recess and held in said recess by said cover, and said plate, spacer and cover being assembled on said arbor between said first and second blade.

2. An adjustable shim comprising:

a plate having an inner face, an outer face, an outside diameter, an inside diameter, an inside wall and an outside wall;

a receiving area located between said plate inside diameter and said plate outside diameter, said receiving area at least partially defined by said plate inside wall, said inner face, and said plate outside wall;

a spacer in said receiving area adjacent said inside wall; and a cover for maintaining said spacer adjacent said inside wall, said cover having an outer face that extends axially beyond said plate outer face when said spacer is adjacent said inside wall.

3. The adjustable shim of claim 2 further comprising:

a second spacer in said receiving area located between said first spacer and said cover.

4. The adjustable shim of claim 3 wherein said first spacer and second spacer have a different thickness.

5. The adjustable shim of claim 4 wherein said shims of different thickness contain indicia of different colors corresponding to the different thicknesses.

6. A method for assembling blades on a table saw arbor to make a tenon comprising;

mounting a first cutting blade on a table saw arbor up against a blade support plate;

pre-assembling an adjustable shim having a plate with a receiving area, a spacer and a cover by placing the spacer inside said receiving area and covering said spacer with said cover;

mounting said adjustable shim on said table saw arbor in a position abutting said first cutting blade;

mounting a second cutting blade on said table saw arbor in a position abutting said adjustable shim;

mounting a washer on said arbor; and mounting a lock nut on said table saw arbor in a position abutting said washer.

7. The method of claim 5 further comprising the step of placing a second spacer in said receiving area of said plate when pre-assembling said adjustable shim.

8. A method for cutting the cheeks of a tenon from a work piece in a single pass comprising;

mounting a first cutting blade on a table saw arbor;

pre-assembling an adjustable shim having a plate with a receiving area, a spacer and cover by placing the spacer inside said receiving area and covering said spacer with said cover;

mounting said adjustable shim on said table saw arbor in a position abutting said first cutting blade;

mounting a second cutting blade on said table saw arbor in a position abutting said adjustable shim;

mounting a washer on said arbor; and mounting a lock nut on said table saw arbor in a position abutting said second cutting blade;

passing said work piece through said first and second cutting blades.

* * * * *